US005247337A

United States Patent [19]

Malachowski

[11] Patent Number: 5,247,337

[45] Date of Patent: Sep. 21, 1993

[54] METHOD AND APPARATUS FOR COPY SHEET FEED TIMED IMAGING REGISTRATION SYSTEM

[75] Inventor: Michael A. Malachowski, Webster, N.Y.

[73] Assignee: Xerox Corporation, Stamford, Conn.

[21] Appl. No.: 900,395

[22] Filed: Jun. 18, 1992

[51] Int. Cl.[5] ..... G03G 21/00

[52] U.S. Cl. ..... 355/308; 355/317

[58] Field of Search ..... 355/308, 309, 311, 316, 355/317; 271/90, 94, 104, 111, 123

[56] References Cited

U.S. PATENT DOCUMENTS

| | | | |
|---|---|---|---|
| 4,029,411 | 6/1977 | Stemmle | 355/51 |
| 4,372,676 | 2/1983 | Miyata et al. | 355/311 X |
| 4,497,569 | 2/1985 | Booth | 355/316 X |
| 4,804,998 | 2/1989 | Miyawaki | 355/316 X |
| 4,887,805 | 12/1989 | Herbert et al. | 271/94 |
| 4,918,489 | 4/1990 | Inage et al. | 355/309 |
| 4,962,404 | 10/1990 | Wakikaido et al. | 355/317 X |
| 4,996,556 | 2/1991 | Gray, Jr. | 355/311 X |
| 5,057,874 | 10/1991 | Miyazaki et al. | 355/316 |
| 5,090,676 | 2/1992 | Matsuno et al. | 271/94 X |
| 5,135,213 | 8/1992 | Malachowski et al. | 271/104 |

*Primary Examiner*—Fred L. Braun

*Attorney, Agent, or Firm*—Oliff & Berridge

[57] ABSTRACT

A printer utilizes a clock for controlling sheet feeding and imaging operations. The system utilizes sheet feeders with sheet feeding rates maintainable within very narrow time tolerances. Thus, sheet feeding events alone or clock pulses alone can be utilized to control the imaging system. The system allows high throughput rates and reduces the complexity and cost of control systems.

15 Claims, 5 Drawing Sheets

METHOD AND APPARATUS FOR COPY SHEET FEED TIMED IMAGING REGISTRATION SYSTEM

BACKGROUND OF THE INVENTION

1. Field of the Invention

This invention relates to control of imagers for forming images on copy sheets. More specifically, the invention relates to an imaging registration system controlled by copy sheet timing or feed initiation.

2. Description of Related Art

In most conventional, commercially available imaging systems, such as the imaging systems for reprographic equipment and printers, the control of the various elements of the machine is based on the imaging operation. The start switch initiates the first step of the imaging process, for example, scanning, and other operations, such as sheet feeding, are initiated on a timed basis, based on the start of the imaging operation. In such systems, copy sheets are fed at a predetermined rate and are held in wait states or registration stations to provide for proper registry of the copy sheet with the appropriate imaging means, such as a photoreceptor belt or drum. The control systems for this equipment are complex and expensive. Moreover, the use of wait states for assuring registration of a copy sheet with the imager introduces delay into the copy cycle, thereby slowing the copy rate and reducing the throughput of the machine.

SUMMARY OF THE INVENTION

It is an object of the invention to increase the processing speed of copy sheets in an imaging or printing apparatus.

It is a further object of the invention to simplify and reduce the cost of control systems for apparatus in which copy sheets are fed at high speeds.

It is a further object of the invention to reduce and/or eliminate wait states in the processing of copy sheets through an imager.

These and other objects of the invention are achieved by the use of a control system wherein work processing stations, for example, an imaging station, are controlled in accordance with feeding of copy sheets from a copy sheet supply. A main clock controls the feeding of sheets and the initiation of processing at downstream work stations. Use of a sheet feeder having highly repeatable sheet delivery times enables control of downstream operations by sensing sheet presence in the feed path.

The drawings illustrate one embodiment of the invention and explain its principles of operations.

DESCRIPTION OF THE PREFERRED EMBODIMENT

Figure 1:
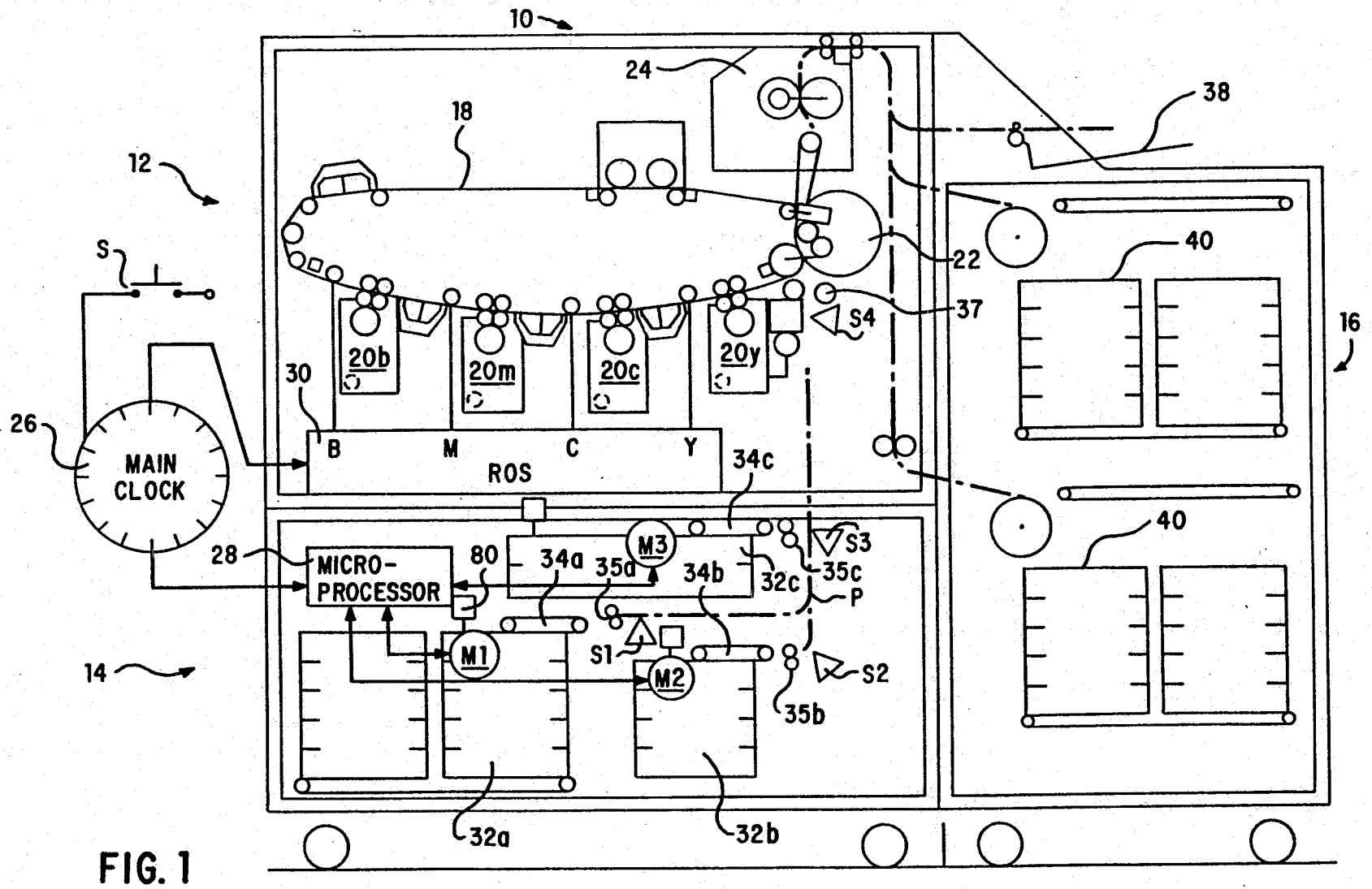
FIG. 1 is a partial sectional view of a printer in accordance with the present invention.

FIG. 1 shows a printer 10 embodying the present invention. The printer 10 comprises an imaging section 12, a sheet supply section 14 and a finished copy receiving station 16. In the printer 10, copy sheets are loaded in trays, such as copy sheet trays 32*a*, 32*b* and 32*c*, each of which may hold a different sized copy sheet. The copy sheets are fed along the sheet feed path P shown in dot and chain line in FIG. 1. The sheets are fed to the imager portion 12 and, after an image is transferred onto each copy sheet, the copy sheet is carried along the path P to a suitable discharge or output point, such as sheet receiving tray 38 or copy stacks 40 in the finished copy section 16.

In imaging station 12, any one of known image forming means or marking engines can be utilized, such as electrostatic toner printers and ink jet printers. In FIG. 1, an electrostatic imaging system is shown wherein a photoreceptor in the form of belt 18 has an electrostatic image formed thereon and a plurality of toner stations 20*b*, 20*m*, 20*c* and 20*y* are arranged to provide black, magenta, cyan, and yellow toners, respectively, to the belt 18. The belt 18 moves to the region of a transfer station 22 wherein the fusable toner is transferred onto the copy sheet, by known means, and thereafter fused onto the copy sheet in a fuser station 24, as is conventional. The operations of the toner stations 20*b*, 20*m*, 20*c* and 20*y* are controlled by a raster output scanner control 30. The construction and operation of such imaging systems are known and no further detailed description of the printing means is necessary.

As previously noted, the supply section 14 includes a plurality of copy sheet trays 32*a*, 32*b*, 32*c*, each of which may accommodate a stack of different sized copy sheets. Each copy sheet tray has a sheet feeder 34*a*, 34*b* or 34*c*, respectively, associated with the copy sheet tray. Each feeder has a motor M1, M2 or M3, respectively, which are under the common control of a control means such as microprocessor 28. The sheet feeders 34*a*–*c* are described in further detail below.

The control system for the printer 10 includes as a primary control element a main clock 26 that issues clock pulses for controlling the microprocessor 28 and the raster output scanner 30 in a manner to be described below. The control may be by means of clock pulses from the clock 26 alone or together with control signals from sensors S1, S2, or S3, each of which is associated with one of the feeders 34*a*, 34*b* or 34*c*, respectively. The sensors may be optical sensors and are positioned to sense the presence of a copy sheet, for example, the leading edge, as it leaves take-away rolls 35*a*, 35*b* or 35*c*, respectively. The sensors S1, S2 and S3 can be utilized to provide control signals, in a second control embodiment, to the microprocessor 28, or directly to the raster output scanner 30 for providing a timing signal to begin operation of the imaging or printing means. Once a copy sheet passes from the take-away rolls, it is conveyed along path P by a suitable arrangement of baffles and drive rolls to the transfer station 22. If desirable, a sensor S4 may be positioned to sense arrival of a copy sheet at transfer station 22. The signal from sensor S4 is provided to microprocessor 28 and may be utilized to drive a feed adjusting roll assembly 37 for fine adjustment of the positioning of a copy sheet as it enters the transfer station 22.

The use of copy sheet feeding as the control for the imager 12 is implemented by use of feeders having accurate and highly repeatable response times so that the time of arrival of a copy sheet at the transfer station 22 can be accurately determined. One such suitable feeder structure is disclosed in Application Ser. No. 07/597,154 filed Oct. 15, 1990, now U.S. Pat. No. 5,135,213, and owned by the assignee of the present application. The disclosure of that application is hereby incorporated by reference.

Figure 2:
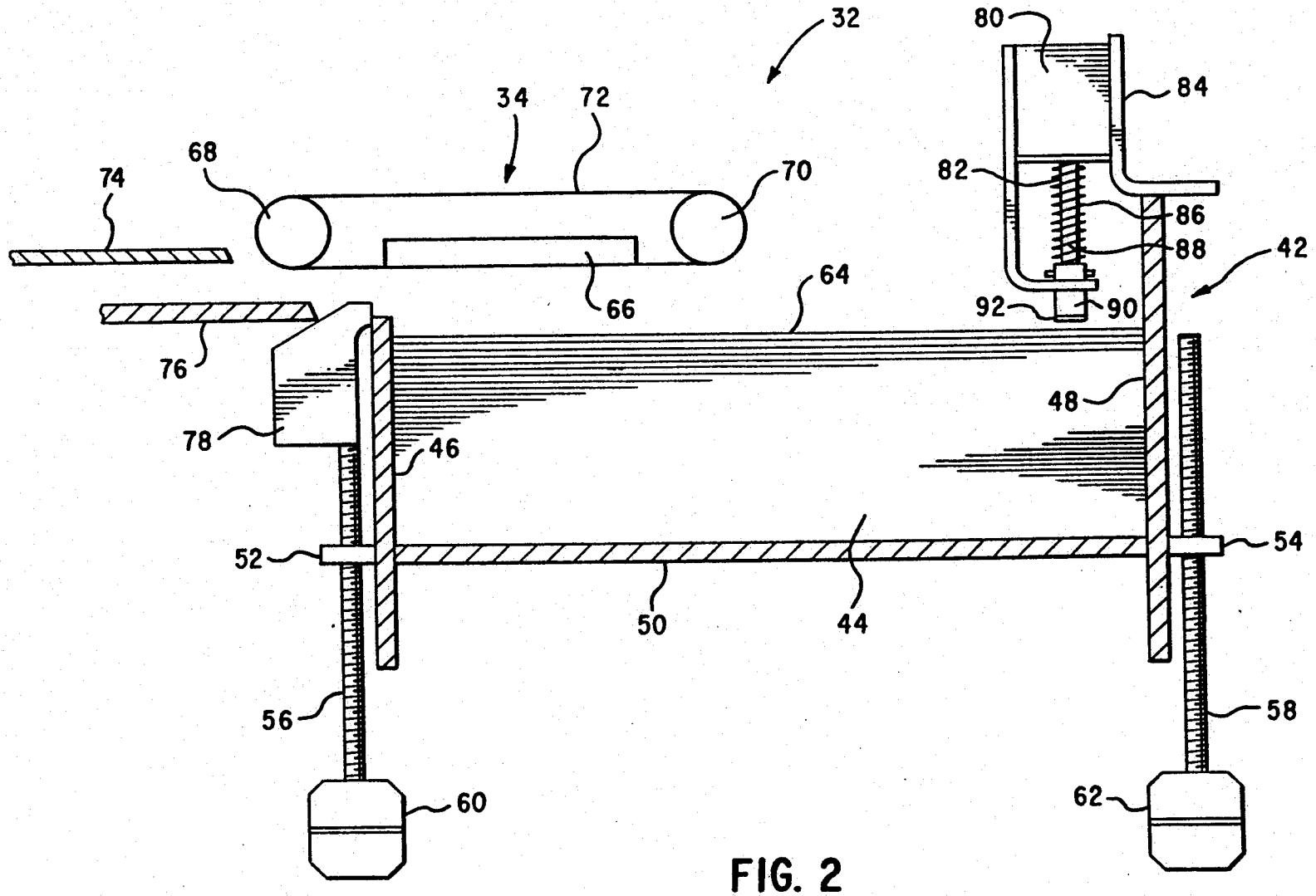
FIG. 2 illustrates in partial section a sheet feeder utilizable with the present invention.

In the feeder disclosed in the above-identified application, there is provided a means for individually feeding sheets from a stack of sheets, including tray means for supporting a stack of sheets to be fed therefrom. As embodied herein, and as depicted in FIG. 2, sheet feeding device 32 includes tray 42 for supporting a stack of sheets 44. Tray 42 includes vertical walls 46 and 48 that may be movable to accommodate sheets of varying lengths. Tray 42 may also include a movable base such as bottom plate 50. Extensions 52 and 54 of bottom plate 50 extend through slots (not shown) in walls 46 and 48. Extensions 52 and 54 threadingly engage lead screws 56 and 58, that are respectively connected to motors 60 and 62. Rotation of motors 60 and 62 in a first direction causes plate 50 to rise while rotation of motors 60 and 62 in a second direction lowers plate 50.

A sensor (not shown) detects when the top sheet 64 of stack 44 falls below a predetermined level. The sensor sends a signal to a controller (not shown) which causes motors 60 and 62 to raise plate 50 and stack 44 a preselected amount.

Also, there is provided feed means for individually capturing a top sheet from the stack and conveying the top sheet out of the tray means. As embodied herein, the feed means may include a standard sheet feeder such as vacuum corrugation feeder 34 positioned above tray 42 with virtually no obstructions therebetween. Vacuum corrugation feeder 34 includes vacuum plenum 66 disposed between drive rollers 68 and 70. Feed belt 72, which includes perforations disposed therein, is entrained about drive rollers 68 and 60. In the alternative, multiple feed belts may be entrained about drive rollers 68 and 70. Vacuum plenum 66 is connected to a vacuum source (not shown). Activation of the vacuum source creates a lower pressure within vacuum plenum 66, thereby drawing air through the perforations in belt 72 and into plenum 66. This flow of air causes top sheet 64 to be drawn against feed belt 72. When drive rollers 68 and 70 are rotated, feed belt 72 conveys a sheet captured against the feed belt out of tray 42 and into a paper path between baffles 74 and 76.

In order to prevent a sheet (the next top sheet) beneath top sheet 64 from adhering to top sheet 64, a blower 78 may be disposed adjacent wall 16 of tray 12. Blower 78 directs a stream of air between a top sheet captured by vacuum plenum 66 and the next top sheet beneath the top sheet. This stream of air is generally sufficient to separate sheets that may be held together by static electricity.

There is also provided hold down means including a portion being cyclically movable toward and away from the stack for exerting a force on the next top sheet beneath the top sheet 64 to prevent the next top sheet from being forwarded out of the tray means while the top sheet is being forwarded out of the tray means. As embodied herein, the hold down means includes solenoid 80 and a movable spring loaded plunger 82 extending therefrom. Solenoid 80 is mounted above the trailing end of stack 44 on L-bracket 84 that is supported on wall 48 of tray 42. Spring loaded plunger 82 includes spring 88 disposed about shaft 86. Cap 90 having a elastomeric tip 92 is mounted on the distal end of shaft 86 via pin 94 that extends through shaft 86 and cap 90.

When solenoid 80 is in a non-actuated state, spring 88 acting between solenoid 80 and cap 90 urges elastomeric tip 92 against the top sheet 64 of stack 44. When solenoid 80 is actuated, elastomeric tip 92 is drawn away from the top sheet 64 of stack 14.

Figure 3:
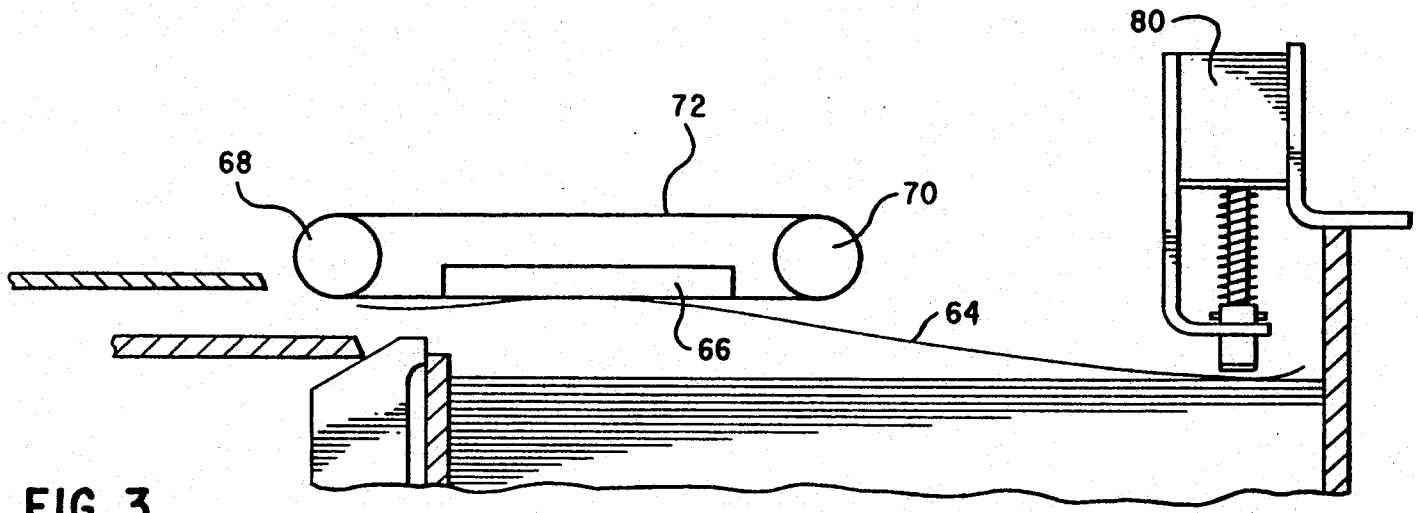
FIG. 3 schematically illustrates a first stage in the sheet feeding operation of the feeder shown in FIG. 2.
Figure 4:
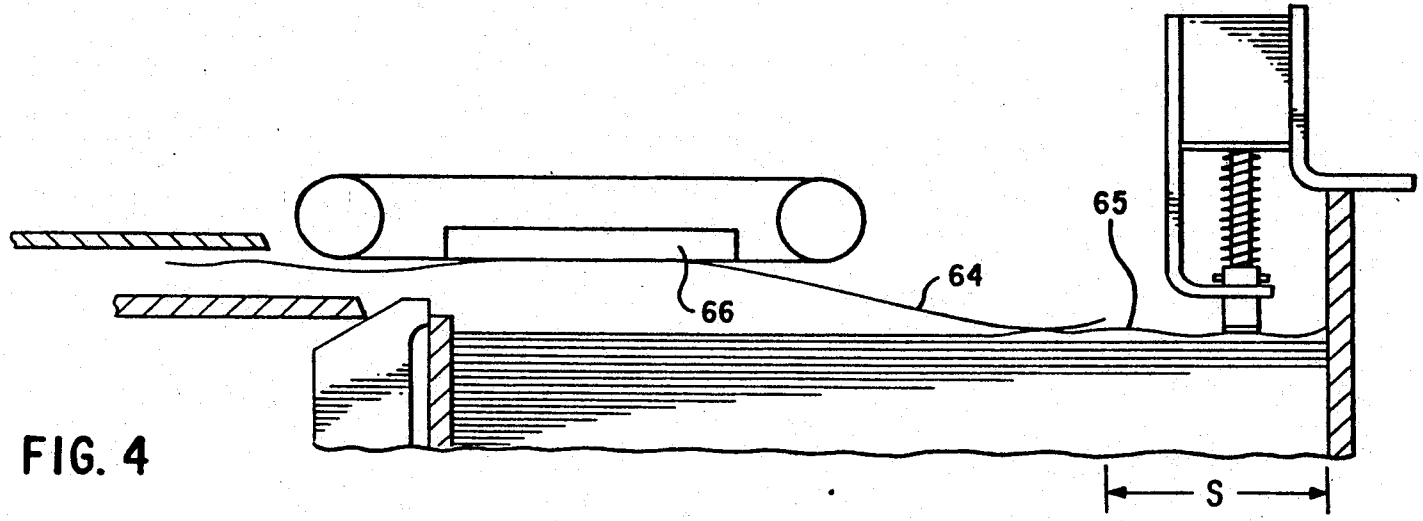
FIG. 4 shows a second stage in the feeding of sheets by the sheet feeder shown in FIG. 2.

Operation of the invention will now be described with reference to FIGS. 3 and 4. Initially, drive rollers 68 and 70 are rotated at a predetermined velocity in order to drive feed belt 72. Microprocessor 28 maintains a virtually constant velocity of feed belt 72 through successive sheet feedings by control of the motors M1, M2 and M3 which drive one of the rollers 68 or 70 of an associated feeder 34. Thus, the feed belt does not start and stop with the feeding of each successive sheet.

The vacuum in vacuum plenum 66 draws top sheet 64 against feed belt 72. Initially, as shown in FIG. 3, solenoid 80 is actuated to release the hold-down force on top sheet 64 and thereby allow it to be forwarded out of tray 42. As soon as a predetermined space S exists between the trailing edge of the top sheet and a corresponding trailing edge of the sheet beneath, solenoid 80 is deactivated by microprocessor 28 to thereby exert a hold-down force caused by spring 88 urging elastomeric tip 92 against the next top sheet 65 beneath top sheet 64. While space S may vary depending on design requirements, it is critical, according to the present preferred embodiments of the invention, that the hold-down force on the next top sheet 65 beneath top sheet 64 be exerted before the trailing edge 70 of top sheet 64 reaches vacuum plenum 66. Otherwise, simultaneous multiple sheet feeding may occur.

Controller 28 coordinates the velocity of drive motors M1–M3 with the operation of solenoid 80. During normal operation, vacuum feed belt 72 runs continuously and sheets are fed each time elastomeric tip 92 is lifted by solenoid 80. Thus, since the time that it takes for the vacuum plenum to acquire the top sheet is very short, the maximum feed rate of the system is limited by the length of time that it takes for the hold down device to be lifted and dropped. Theoretically, the solenoid can be actuated by controller 28 at a maximum rate of 3200 actuations per minute.

Figure 5:
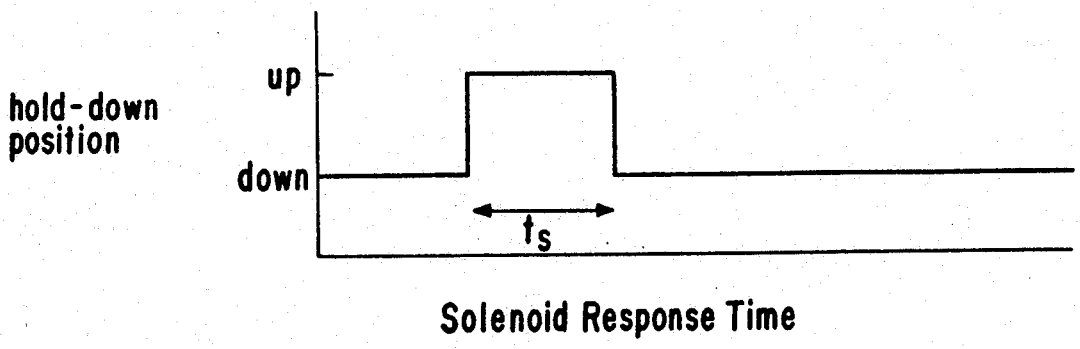
FIG. 5 is a graph illustrating the response time of a solenoid employed in the feeder shown in FIG. 2.

Assuming that the hold down device is lifted from the stack instantaneously and that it can also be dropped instantaneously, the hold down time ($t_s$) may be depicted graphically as shown in FIG. 5.

To avoid simultaneously feeding multiple sheets, the hold down mechanism should be dropped before the trailing edge of the sheet being fed exposes the vacuum ports in feed belt 72 to the sheet beneath the sheet being fed. This requirement also limits the maximum speed ($V_{pmax}$) at which the feed belts may run as described below.

$$V_{pmax} = \frac{(d_p - d_v)}{t_s}$$

Figure 6:
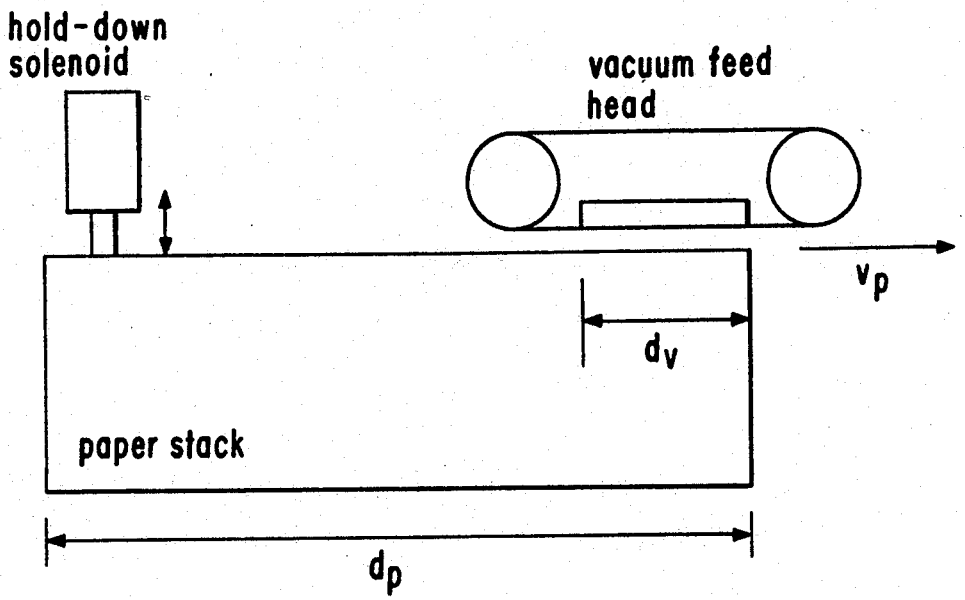
FIG. 6 is a schematic illustration of sheet feeding apparatus depicting various dimensions.

As depicted in FIG. 6, $d_p$ represents the length of the paper stack, and $d_v$ represents the distance between the leading edge of the stack and the trailing edge of the vacuum plenum.

The maximum copy sheet feed rate ($R_{cpm}$) is then limited by the feed belt speed ($V_{pmax}$), the paper length ($d_p$) and the required copy gap ($d_{cg}$), i.e., the required gap between the trailing edge of a sheet being fed and the leading edge of the subsequent sheet being fed. These values are related as shown below. and therefore:

$$R_{cpm} = 60 \frac{(V_{pmax})}{d_p + d_{cg}}$$

$$R_{cpm} = 60 \frac{(1)}{ts} \frac{(d_p - d_v)}{(d_p + d_{cg})}$$

From the above equation, it can be observed that the maximum copy sheet feed rate is inversely proportional to the solenoid response time. In addition, the maximum copy sheet feed rate increases as $d_v$ and $d_{cg}$ decrease and as $d_p$ increases.

Solenoid 80 should be capable of being operated at frequency of 0–3200 actuations per minute, or greater, preferably in the range of 100–1200 actuations per minute.

Figure 7:
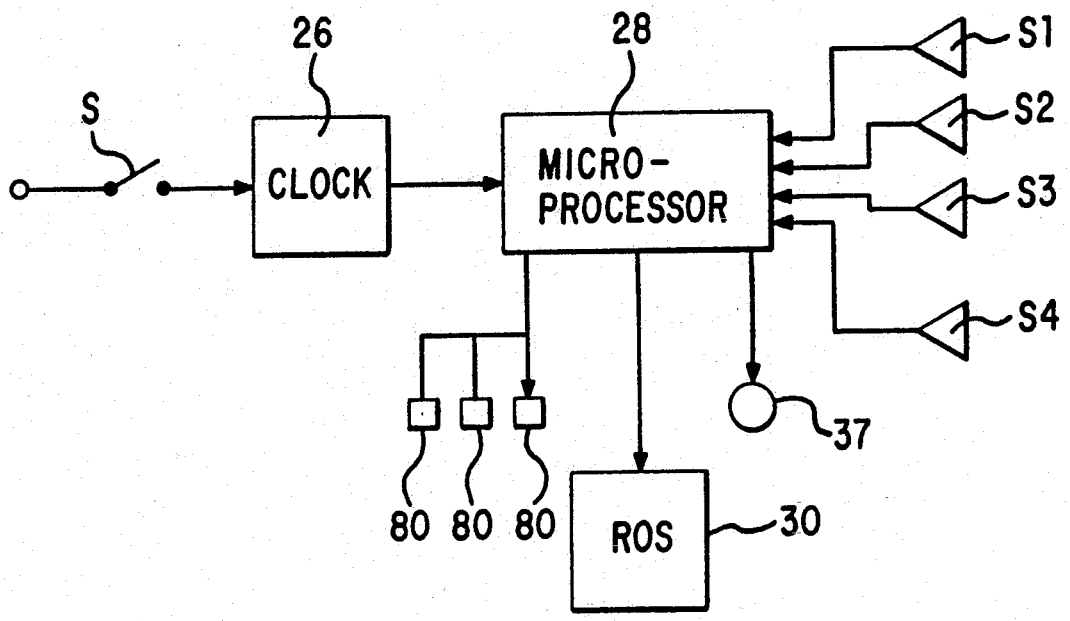
FIG. 7 is a diagram of a control system embodying the invention

Referring to FIG. 7, the main clock 26 is activated when start print switch S is closed. The clock 26 provides clock pulses at predetermined intervals, depending on copy sheet size and desired copy rate, to microprocessor 28 to energize one of the solenoids 80 to release a copy sheet from the appropriate tray 32. Because the arrival time of the copy sheet at transfer station 22 is highly predictable, the clock 26 can also provide control pulses for timing the operation of the imaging apparatus 12, through microprocessor 28 or directly to raster output scanning 30. The operation of the imaging system can also be triggered by pulses from sensors S1, S2 or S3. The use of the sensors to trigger the imaging system avoids operation of the imaging system in the event a sheet misfeeds from one of the trays 34. If additional registration accuracy is desired, the sensor S4 can be utilized to sense the leading edge of a copy sheet just before the transfer station 22 and the timing of the copy sheet at the transfer station 22 can be finely adjusted by controlling the speed of servo roll assembly 37. The speed adjustment determination can be implemented in the microprocessor 28 on the basis of the timing of the signal from sensor S4. Suitable software routines for accomplishing such adjustment are known and no further description thereof is necessary.

An advantage of the foregoing described feeder is that the variation in feeding times from sheet to sheet is extremely low. In experiments utilizing the feeder shown in FIG. 2–6 in a printer as shown in FIG. 1, the measurements given in Table 1 were observed.

TABLE 1

| Measurement (seconds std. dev.) | 135 CPM | 180 CPM | 300 CPM | 500 CPM | 600 CPM |
|---|---|---|---|---|---|
| Time from feed signal until leading edge adjacent transfer | 1.980<br>0.0017 | 1.546<br>0.0010 | 0.858<br>0.0007 | 0.471<br>0.0011 | 0.366<br>0.0009 |

The results in Table 1 show that the standard deviation of arrival time of the leading edge of copy sheets, for a feed path length between 3 to 4 feet, is very low, indicating a highly repeatable and predictable arrival time at the transfer station from the time a feed signal is provided to a solenoid 80. As a consequence, the feed signal itself, or a sheet detection signal from one of the sensors S1, S2 or S3 can be utilized to initiate operation of the imaging section 12, with a high degree of confidence that the image will be properly positioned on the copy sheet when the copy sheet passes through the transfer station 22.

Control systems according to the present invention present a very significant cost reduction yet enable high speed operations. The system is especially useful when skew requirements are not severe and registrations fingers are not necessary. Further, the use of sensors to indicate passage of sheets from the take-away rolls eliminates contamination and/or dirt problems associated with cleaning of a photoreceptor when a misfeed occurs in the feeders. The system can further enhance guaranteed printing by the use of communication links between the imaging system and the paper handling section.

What is claimed is:

1. Printing apparatus comprising:
- a switch for initiating a printing cycle;
- a clock responsive to said switch for issuing timed control signals;
- a copy sheet source;
- an imager for forming images received on copy sheets from said copy sheet source;
- means defining a feed path for feeding copy sheets from the copy sheet source to the imager;
- copy sheet feeding means responsive to the timed control signals from the clock for feeding copy sheets from the copy sheet source into the feed path; and
- a sensor in the feed path adjacent the copy sheet source for initiating operation of the imager in response to detection of a copy sheet in the feed path.

2. Printing apparatus as in claim 1, and further comprising an adjusting roll in the feed path for adjusting the time of arrival of a copy sheet at the imager.

3. Printing apparatus as in claim 1, wherein the imager is an electrostatic printer.

4. Printing apparatus as in claim 1, wherein the copy sheet feeding means comprises:
- a sheet supply member;
- a sheet feeder for feeding sheets from the supply member; and
- a holding device for holding a topmost sheet in the sheet supply member, said holding device being responsive to said control signal to release sheets from the sheet holding member.

5. A printing apparatus as in claim 4, wherein the sheet feeder comprises a continuously running member for drawing sheets from the sheet supply member and the holding device comprises an electrically actuable member.

6. A printing apparatus as in claim 5, wherein the holding device comprises a solenoid.

7. Printing apparatus as in claim 1, and further comprising an adjusting roll in the feed path for adjusting the time of arrival of a copy sheet at the imager.

8. A printing apparatus as in claim 1, wherein a signal from the sensor comprises the sole control for initiating operation of the imager in a printing cycle.

9. Printing apparatus comprising:

initiating means for initiating a printing operation;

a clock responsive to the initiating means for issuing timed control signals;

a copy sheet source;

an imager for forming images on copy sheets from the copy sheet source;

means defining a feed path for feeding copy sheets from the copy sheet source to the imager;

copy sheet feeding means responsive to timed control signals from the clock for feeding copy sheets from the copy sheet source into the feed path; and imager initiating means for initiating operation of the imager solely in response to a timed signal from the clock.

10. Printing apparatus as in claim 9, wherein the imager is an electrostatic printer.

11. Printing apparatus as in claim 9, wherein the copy sheet feeding means comprises:

a sheet supply member;

a sheet feeder for feeding sheets from the supply member; and a holding device for holding a topmost sheet in the sheet supply member, said holding device being responsive to said control signal to release sheets from the sheet holding member.

12. A printing apparatus as in claim 11, wherein the sheet feeder comprises a continuously running member for drawing sheets from the sheet supply member and the holding device comprises an electrically actuable member.

13. A printing apparatus as in claim 12, wherein the holding device comprises a solenoid.

14. A method for controlling a printing apparatus having a copy sheet source and an imager for forming images on copy sheets from the copy sheet source comprising the steps of:

initiating operation of the printing apparatus by enabling a clock to provide timed control signals;

initiating feeding of sheets from the copy sheet source by providing timed signals from the clock to a copy sheet feeder;

sensing a copy sheet in a feed path extending from the copy sheet source to the imager; and initiating operation of the imager solely upon sensing of a copy sheet in a portion of the feed path adjacent the copy sheet source, whereby the imager is prepared to form an image on the copy sheet a predetermined time from the sensing of a sheet in the feed path.

15. A method for controlling printing apparatus having a copy sheet source and an imager for forming images on copy sheets from the copy sheet source comprising the steps of:

initiating operation of the printing apparatus by enabling a clock to provide timed control signals;

initiating feeding of sheets from the copy sheet source solely by providing timed signals from the clock to a copy sheet feeder; and initiating operation of the imager solely by providing a timed signal from the clock, whereby the imager begins forming an image on a copy sheet a predetermined time after the clock sends a signal to initiate operation of the copy sheet feeder to feed said copy sheet.

* * * * *